United States Patent [19]

Elders et al.

[11] Patent Number: 4,933,656

[45] Date of Patent: Jun. 12, 1990

[54] METHOD OF SEVERING AN ANNULAR CORE OF FERROMAGNETIC MATERIAL INTO SEPARATE PARTS, AND TELEVISION TUBE DEFLECTION UNIT COMPRISING AN ANNULAR CORE SO SEVERED

[75] Inventors: Marinus J. A. Elders; Frederik J. G. Abbringh, both of Eindhoven, Netherlands

[73] Assignee: U.S. Philips Corporation, New York, N.Y.

[21] Appl. No.: 69,689

[22] Filed: Jul. 6, 1987

[30] Foreign Application Priority Data

Aug. 6, 1986 [NL] Netherlands ..... 8602006

[51] Int. Cl.[5] ..... H01F 7/00

[52] U.S. Cl. ..... 335/210; 219/121.67

[58] Field of Search ..... 335/210; 219/121.67, 219/121.7, 121.71, 121.72

[56] References Cited

U.S. PATENT DOCUMENTS 4,356,376 10/1982 Komanduri et al. ..... 219/121.7 X
4,590,652 5/1986 Harwood ..... 219/121.67 X
4,818,840 4/1989 Booth et al. ..... 219/121.67 X

FOREIGN PATENT DOCUMENTS 0110888 5/1987 Japan ..... 219/121.67

*Primary Examiner*—George Harris
*Attorney, Agent, or Firm*—Algy Tamoshunas; Leroy Eason

[57] ABSTRACT

A method of longitudinally severing a longitudinally symmetrical annular core of ferromagnetic material into two parts. By means of a laser, two lines of recesses are inscribed in the surface of the annular core substantially in the longitudinal direction. The recesses are shaped so that the resulting weakening of the annular core along the lines of recesses causes it to spontaneously fracture into two parts along such lines.

9 Claims, 2 Drawing Sheets

METHOD OF SEVERING AN ANNULAR CORE OF FERROMAGNETIC MATERIAL INTO SEPARATE PARTS, AND TELEVISION TUBE DEFLECTION UNIT COMPRISING AN ANNULAR CORE SO SEVERED

BACKGROUND OF THE INVENTION

1. Field of the Invention

The invention relates to a method of longitudinally severing a longitudinally symmetrical annular core of ferromagnetic material for a television tube deflection unit into two parts.

The invention also relates to a television tube deflection unit comprising an annular core severed according to such a method.

2. Description of the Related Art

Such a method is disclosed in U.S. Pat. No. 4,471,261. According to the known method, severing grooves are ground in the annular core during a grinding treatment along which grooves the annular core can be severed. Severing is generally done by using a gas flame or by providing mechanical stress, for example, by tapping. However, the annular core, which may be conical or flared, has such a large rigidity due to its shape that severing occurs in a manner in an undesired large number of cases, that is it does not take place along the severing groove, which leads to a large reject percentage.

SUMMARY OF THE INVENTION

It is the object of the invention to provide a method of longitudinally severing such a longitudinally symmetrical annular core in a defined manner so that the number of rejects is reduced to a satisfactory extent.

For that purpose, the method according to the invention is characterized in that a series of substantially adjoining recesses are provided in the annular core by means of a pulsated beam, said series of recesses forming two oppositely located lines on the surface of the core extending substantially in the longitudinal direction thereon, the recesses being given such a shape that the annular core after providing the series of recesses thereon fractures into two parts. By providing such a line of recesses in the annular core, the annular core is locally weakened. By giving the recesses such a shape by means of the pulsated laser beam that the produced local weakenings are exceeded by the internal stresses of the ferromagnetic annular core, the annular core fractures spontaneously into two parts along the lines after providing the series of recesses. Since the annular core fractures spontaneously into two parts along the lines, a readily defined severing is obtained, which leads to a small reject percentage.

An embodiment of the method in accordance with the invention is characterized in that the recesses are formed by holes which overlap each other in part. It has been found in practice that recesses provided in the form of holes which overlap each other in part leads to good results as regards the severing of the annular core.

Moreover it has been found that the local weakening which is produced by a line of recesses in the form of holes in the annular core partly overlapping each other will be exceeded by the internal stresses of the annular core before the line of recesses has reached the end of the annular core.

A further embodiment of the method in accordance with the invention is characterized in that the lines formed by the series of recesses are provided on the annular core in the form of a profile. When the annular core fractures into two parts along profiled lines which, for example, show a zig-zag shape, the resulting parts of the annular core can be fitted together again unambiguously during the assembly.

A further embodiment of the method in accordance with the invention is characterized in that the annular core has a wall thickness in the range from 2 to 4 mm. In particular with an annular core having such a small wall thickness it has been found that severing of the annular core according to the invention is very suitable. Due to the small wall thickness, severing of such an annular core according to conventional methods meets with problems in particular as regards the reproducibility of the severing, which leads to an undesired large reject percentage.

BRIEF DESCRIPTION OF THE DRAWINGS

A few embodiments of the invention will now be described in greater detail, by way of example, with reference to the drawing.

DESCRIPTION OF THE PREFERRED EMBODIMENTS

Figure 1:
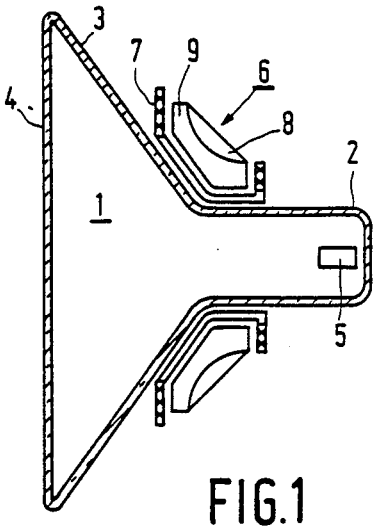
FIG. 1 is a diagrammatic longitudinal sectional view of a television tube having a deflection unit.

FIG. 1 is a diagrammatic longitudinal sectional view of a television tube 1 for monochrome or colour television. It consists of a cylindrical neck portion 2 and an adjoining longitudinally symmetrical portion 3, such as cinical or flared, which is closed by a display screen 4. Present in the neck portion 3 is an electrode system 5 shown diagrammatically with which, for example, one electron beam (in the case of a monochrome display tube) or three electron beams (in the case of colour television) can be generated. At the area of the transition from the neck portion 2 to the flared portion 3 a deflection unit 6 which coaxially surrounds the tube 1 is provided on the tube 1 and consists of a first pair of (saddle-shaped) deflection coils 7 for deflecting the electron beams in a horizontal direction, a second pair of (toroidal) deflection coils 8 for deflecting the electron beams in the vertical direction and an annular core 9 which supports the pair of coils 8 and is adapted to the flared shape of the display tube 1. The horizontal deflection coils 7 are situated on each side of a horizontal deflection plane which in the case of an in-line television tube coincides with the plane in which the three electron beams extend. The vertical deflection coils 8 are also situated on each side of said horizontal deflection plane. The vertical deflection plane is perpendicular hereto and hence coincides with the plane of the drawing.

Figure 2:
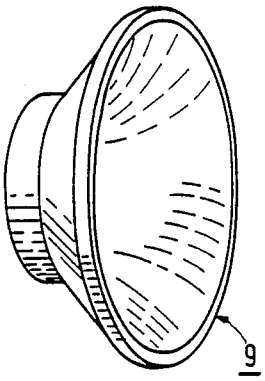
FIG. 2 is a perspective view of an unsevered annular core.

The annular core 9 is manufactured from sintered, oxidic, ferromagnetic material, for example, MgMnZn-ferrite, LiMnZn-ferrite, or NiZn-ferrite. It flares towards the front as is shown diagrammatically in FIG. 2 so that it fits around the pair of deflection coils 7 with a small amount of play.

Figure 3:
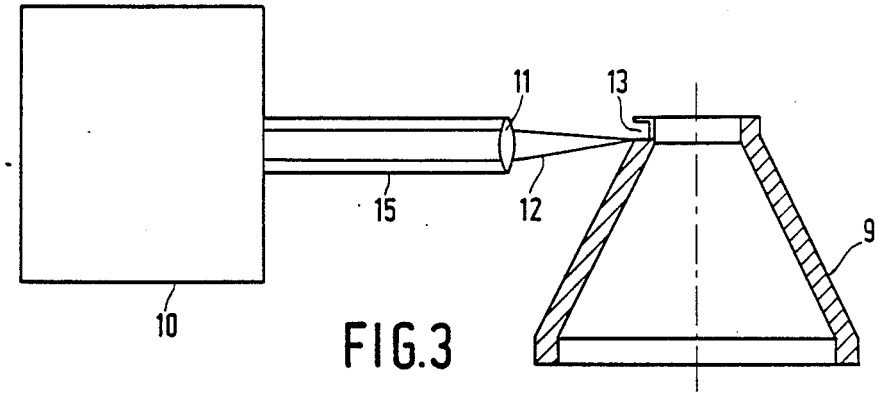
FIG. 3 shows diagrammatically an embodiment of the method according to the invention.
Figure 4:
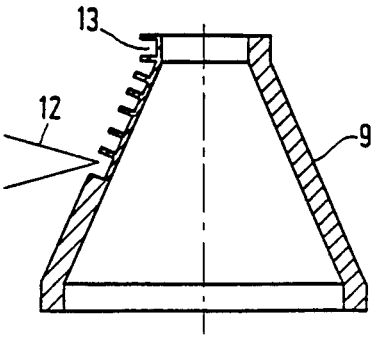
FIG. 4 is a diagrammatic sectional view of an annular core having a number of recesses provided according to an embodiment of the method in accordance with the invention.

FIG. 3 shows diagrammatically an embodiment of the method according to the invention. A laser, indicated by the element 10, transmits coherent radiation 12 in the form of pulses which are focused on the annular ring 9 via an optical tube 15 by means of a system of lenses which are shown diagrammatically by element 11. The focused pulsated laser beam 12 evaporates a part of the ferromagnetic material of the annular core 9 so that a local weakening in the form of a recess 13 is formed in the annular core 9 (see FIG. 4). By moving the pulsated laser beam 12 over the surface of the annular core 9, a line of recesses is inscribed. The evaporation of the ferromagnetic material of the annular core for the local weakening of the annular core requires a correct adjustment of the laser which depends inter alia on the ferromagnetic material used and the desired shape of the recess.

The shape of the recess, notably the depth of the recess, and the mutual distance between the recesses are decisive for the ultimately produced weakening in the annular core, which is important for the spontaneous fracturing of the annular core. The shape of the recess for obtaining a spontaneous fracturing is determined inter alia by the ferromagnetic material of the annular core and the wall thickness of the annular core. For example, the minimum depth of the recesses should be determined with reference to the material used. The recesses in a series should adjoin each other substantially to obtain a sufficient local weakening.

It has been found in practice that the method according to the invention is suitable for severing annular cores having a wall thickness in the range from 2 to 4 mm.

Figure 5A:
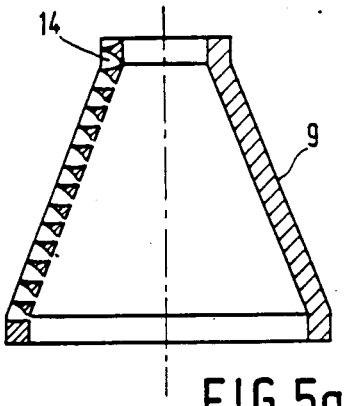
FIGS. 5*a* and 5*b* are a diagrammatic sectional view and an elevation, respectively, of an annular core having a number of recesses provided according to a further embodiment of the method in accordance with the invention.
Figure 5B:
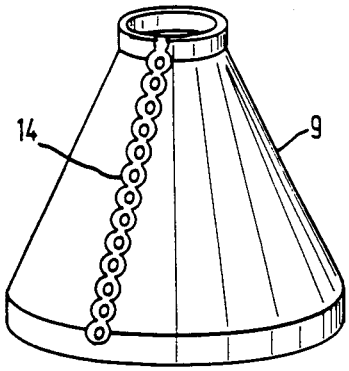

In an embodiment of the method according to the invention a Q-switched Nd : Yag laser was used by way of radiation of 1.06/μm at a pulse frequency of 9000 Hz and power of 3 W. As a result of this recesses in the form of substantially funnel-like holes 14 as shown diagrammatically in FIG. 5*a* were obtained in an annular core of MgMnZn-ferrite having a wall thickness of 3.5 mm. The rate at which the focused laser beam was moved over the surface of the annular core to obtain overlapping holes 14, shown in the elevation of FIG. 5*b*, was 2.5 mm/sec. The laser beam 12 was guided by an optical tube 15 in the form of glass fibres with optical system 11 the coupling-out focus of which was 50 mm.

It was found that the local weakening which produced the line of recesses 14 inscribed in the annular core 9 was surpassed by the internal stresses of the annular core 9 at an instant at which the line of recesses 14 was still some distance from the end of the annular core 9. At the said instant the annular core 9 fractures spontaneously in the elongation of the provided line of recesses 14, producing a banging sound. After one line of recesses had been provided the annular core was turned through approximately 180° with respect to the laser beam and the next line of recesses was provided. The annular core fractured into two parts after the recesses had been provided according to the desired line at the instant at which the internal stresses of the annular core surpassed the weakening caused in the annular core by the provided recesses.

Figure 6:
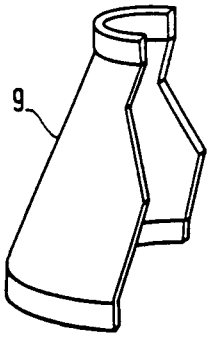
FIG. 6 is an elevation of a part of an annular core obtained according to a further embodiment of the method in accordance with the invention.

When the lines of recesses are given a profiled shape it is found in practice that the halves of the annular core can simply be mounted together unambiguously. In the elevation of FIG. 6 one half of the annular core 9 is shown which has been severed according to a profiled zig-zag line. It will be obvious that the profiled line may also be given other shapes.

Figure 7:
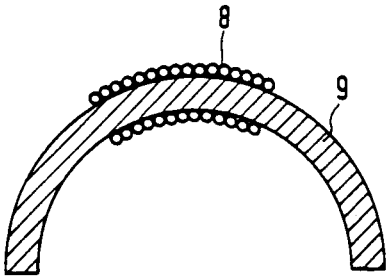
FIG. 7 is a cross-sectional view through a part of an annular core.

An annular core of ferromagnetic material is used inter alia in a deflection unit 6 of a television tube 1 (see FIG. 1). The annular core 9, sometimes termed yoke ring, supports the pair of coils 8. Before the coils can be wound on the yoke ring, the yoke ring is severed into halves according to the method of invention. FIG. 7 is a diagrammatic sectional view of one half of the yoke ring 9 on which the coil 8 has been wound. When the halves of the yoke ring have been wound, said halves can be connected together again, for example, by using clamping springs or by means of a glue.

It will be obvious that the method according to the invention is not restricted to the embodiment described, but that many variations are possible to those skilled in the art without departing from the scope of this invention. For example, it is possible to provide two lines of recesses simultaneously in the annular core by using two pulsated laser beams.

What is claimed is:

1. A method of longitudinally severing a longitudinally symmetrical annular core of ferromagnetic material into two parts; such method being characterized in that two series of substantially adjoining recesses are inscribed on the surface of the annular core by means of a pulsated laser beam, such two series of recesses forming two oppositely located lines on such surface extending substantially in the longitudinal direction thereon, the recesses being given such a shape that they produce local weakenings in the annular core which cause the annular core to fracture into two parts along said lines.

2. A method as claimed in claim 1, characterized in that the recesses are formed by holes which partially overlap each other.

3. A method as claimed in claim 1, characterized in that the lines formed by the series of recesses are in the form of a profile.

4. A method as claimed in claim 1, characterized in that the annular core has a wall thickness in the range from 2 to 4 mm.

5. A deflection unit for a television tube comprising an annular core which has been severed into two parts according to the method claimed in claim 1.

6. A method as claimed in claim 1, characterized in that the annular core is of longitudinally conical shape.

7. A method as claimed in claim 6, characterized in that the annular core has a wall thickness in the range from 2 to 4 mm.

8. A deflection unit as claimed in claim 5, characterized in that the annular core has a wall thickness in the range from 2 to 4 mm.

9. A deflection unit as claimed in claim 8, characterized in that the annular core is of longitudinally conical shape.

* * * * *